US005095671A

United States Patent [19]

Mitani

[11] Patent Number: 5,095,671

[45] Date of Patent: Mar. 17, 1992

[54] FRAMEWORK OF A BUILDING

[76] Inventor: Tadahiro Mitani, 227, Nenarigaki, Yamatotakada, Nara, Japan

[21] Appl. No.: 545,895

[22] Filed: Jun. 29, 1990

[30] Foreign Application Priority Data

Aug. 29, 1989 [JP] Japan ..... 1-100587[U]

[51] Int. Cl.[5] ..... E06B 1/04; E04B 2/00

[52] U.S. Cl. ..... 52/210; 52/780; 52/455

[58] Field of Search ..... 52/780, 781, 655, 657, 52/202, 207, 474, 475, 476, DIG. 10, 488, 81, 210, 455; 49/501

[56] References Cited

U.S. PATENT DOCUMENTS

| | | | |
|---|---|---|---|
| 323,030 | 7/1885 | Elford | 52/780 |
| 1,079,112 | 11/1913 | Conzelman | 52/780 |
| 1,607,166 | 11/1926 | McCall | 52/828 |
| 1,797,440 | 3/1931 | New | 52/731 |
| 3,226,903 | 1/1966 | Lillethun | 52/456 |
| 3,295,283 | 1/1967 | Griffith et al. | 52/781 |
| 3,512,320 | 4/1970 | Ferron et al. | 52/456 |
| 4,044,518 | 8/1977 | Hodge | 52/780 |
| 4,387,545 | 6/1983 | Kern | 52/455 |
| 4,577,444 | 3/1986 | Sanderson | 52/476 |

FOREIGN PATENT DOCUMENTS

| | | | |
|---|---|---|---|
| 2031051 | 4/1980 | United Kingdom | 52/780 |

*Primary Examiner*—John E. Murtagh
*Assistant Examiner*—Robert Canfield
*Attorney, Agent, or Firm*—Wenderoth, Lind & Ponack

[57] ABSTRACT

A framework of a wooden building has a pair of vertically extending pillars formed on opposite sides thereof with longitudinal grooves and a wall panel mounted between the pillars, having its side edges inserted in the grooves in the pillars. A diagonal pillar formed in the opposite sides thereof with grooves may be provided between the vertical pillars to support two triangular wall panels. A fitting such as a window sash may be mounted between the pillars so as to be sandwiched between upper and lower wall panels.

14 Claims, 4 Drawing Sheets

FRAMEWORK OF A BUILDING

BACKGROUND OF THE INVENTION

This invention relates to a framework forming a wall of a wooden building.

Recently, as methods for constructing a wooden building, the two-by-four method, panel method and laminated lumber method have been proposed, in addition to traditional or conventional methods. A metal panel method is also gaining popularity.

Each of these methods has its merits and demerits. In selecting one of them, the customer's taste and economic conditions have to be taken into account.

Among these methods, the conventional methods are superior to the other methods when it comes to constructing a wooden building adapted to climatic and other natural conditions in Japan.

While the buildings constructed by the conventional methods are highly resistant to earthquakes and winds and can withstand prolonged use if they are kept in good conditions, these methods are difficult and require materials of high quality and skilled hands, which are both difficult to come by. These methods also require a long time for construction and are thus very costly.

SUMMARY OF THE INVENTION

It is an object of this invention to provide a framework of a building which can be constructed efficiently and inexpensively while retaining the advantages of the conventional methods.

In a first embodiment, pillars and a wall panel can be joined together by inserting the side edges of the wall panel in grooves formed in the pillars.

In a second embodiment, the pillars, a diagonal pillar and the wall panels can be joined together by inserting the side edges of the wall panels in the grooves formed in the pillars and the diagonal pillar.

In a third embodiment, the pillars, the wall panels and a fitting can be joined together by inserting the side edges of the wall panels and the fitting in the grooves formed in the pillars.

According to this invention, the wall panels are mounted to extend vertically by inserting their side edges in the grooves formed in the pillars. A framework of a wooden building can thus be constructed by a prefabricated construction method. This makes possible the shop fabrication of its component parts. Its cost can be reduced remarkably because its parts can be mass-produced and its assembly is simple.

The wall panels and the diagonal pillar offer a strong wall surface and make it possible to build-in a fitting such as a window sash by the prefabricated construction method.

BRIEF DESCRIPTION OF THE DRAWINGS

Other features and objects of the present invention will become apparent from the following description taken with reference to the accompanying drawings, in which.

DETAILED DESCRIPTION OF THE PREFERRED EMBODIMENTS

The embodiments of this invention will be described with reference to the accompanying drawings.

Figure 1:
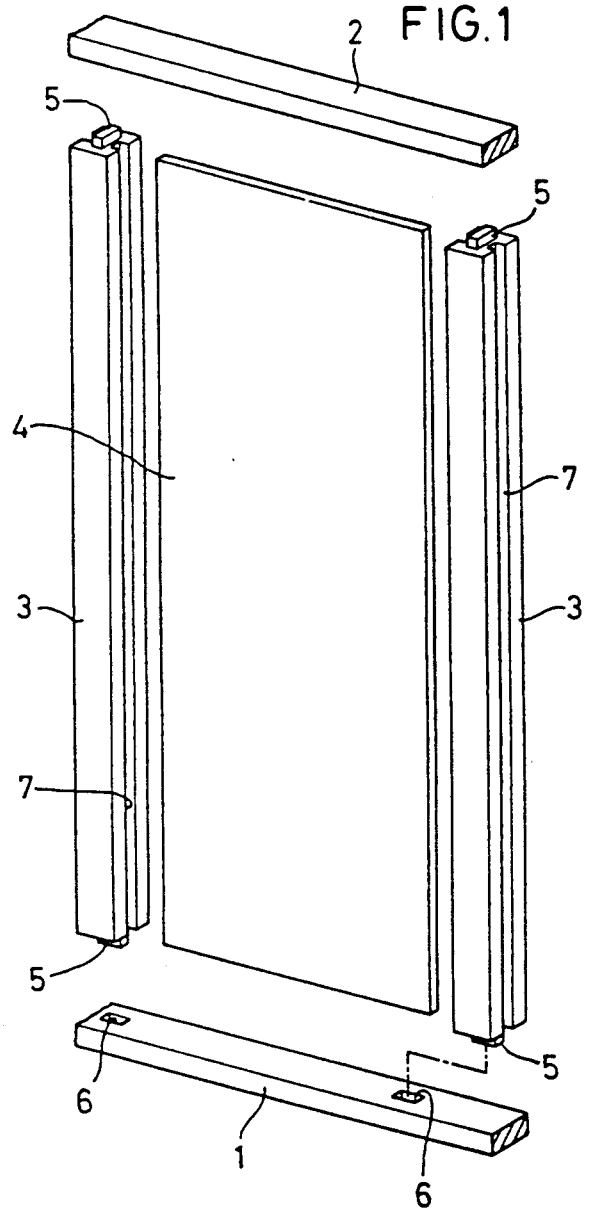
FIG. 1 is an exploded perspective view of a first embodiment of the present invention.
Figure 2:
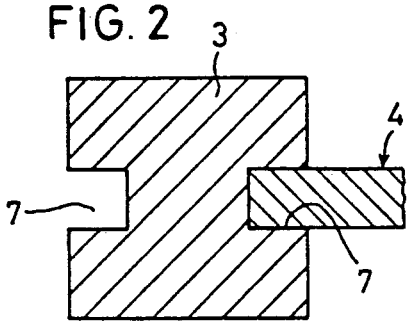
FIGS. 2 and 3 are cross sectional plan views of portions of the first embodiment.
Figure 3:
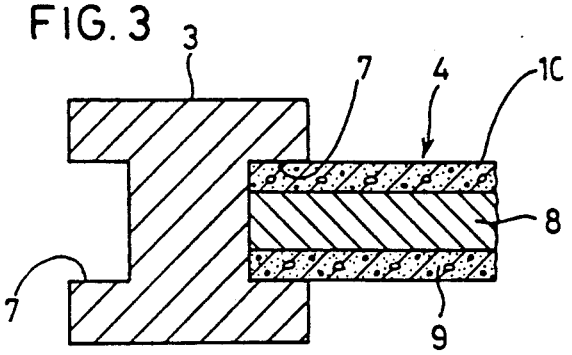

FIGS. 1 to 3 show a first embodiment, which comprises a sill 1, a pole plate 2, a pair of vertical pillars 3 disposed between the sill 1 and the pole plate 2 at a predetermined spacing, and a wall panel 4 extending vertically between the pillars 3. The pillars are coupled to the sill 1 and the pole plate 2 by inserting tenons 5 formed on both ends thereof into mortices 6 formed in the sides opposite to each other of the sill 1 and the pole plate 2, the pillars 3 also having longitudinal grooves 7. The wall panel 4 forming a wall surface of a building is coupled to the pillars 3 by inserting its side edges in the grooves 7.

The thickness of the panels 4 of this embodiment, as well as those of the other embodiments, may vary according to the purpose of their use. For example, as shown in FIG. 2 if the wall panel is rather thin (e.g. 30 mm thick), it should be made of laminated lumber.

Its interior surface may or may not be covered with cloth or spray-covered. Its exterior surface should be waterproofed by a spray coating or siding.

If the all panel 4 is thick (e.g. 60 mm), it may have a three-layer construction, as shown in FIG. 3, each layer being made of different materials, with a core 8 made of laminated lumber or foamed styrol, an inner wall 9 in the form of a plaster board or a hardboard and an outer wall 10. In selecting materials, the strength and cost of the panel have to be taken into consideration.

Figure 4:
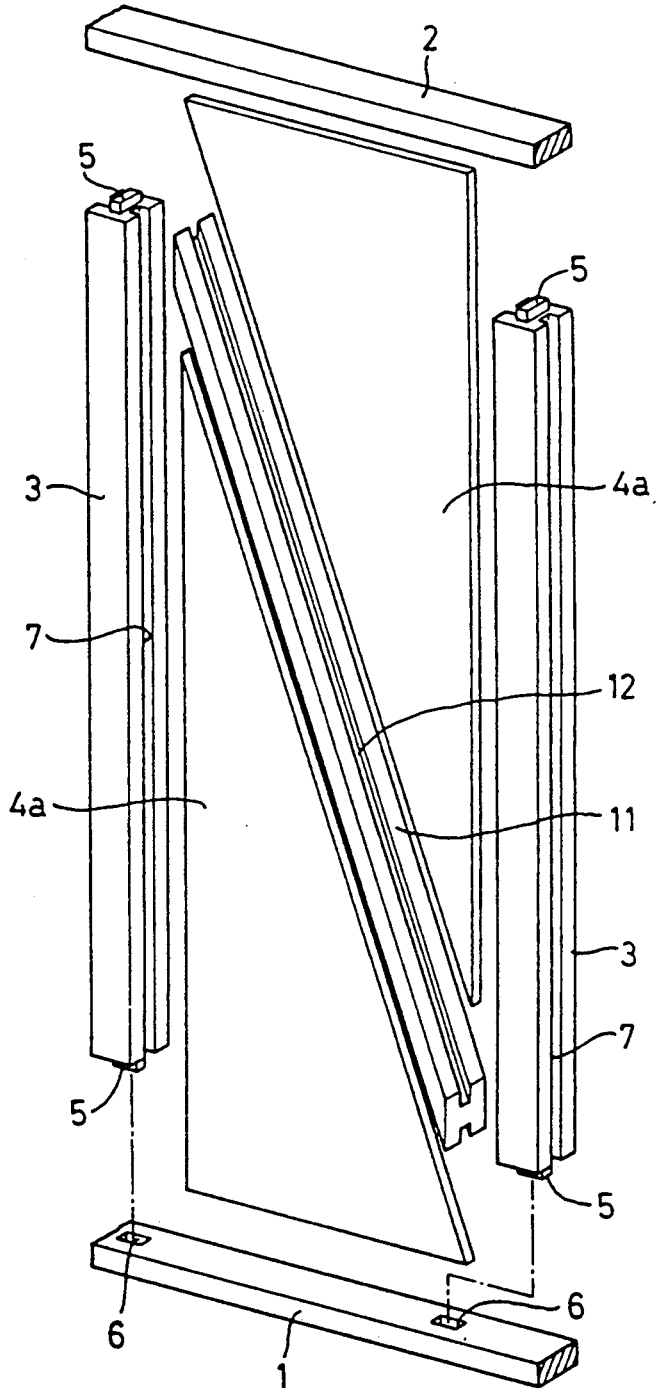
FIG. 4 is an exploded perspective view of a second embodiment.

FIG. 4 shows the second embodiment, which comprises a sill 1, a pole plate 2, a pair of vertical pillars 3, a diagonal pillar 11 extending diagonally between the vertical pillars 3, and two wall panels **4*a* secured to the vertical pillars 3 and the diagonal pillar 11**.

The pillars 3 are fixed to the sill 1 and the pole plate 2 in the same manner as with the first embodiment shown in FIG. 1. Longitudinal grooves 7 are formed in the opposite sides of the pillars 3.

Longitudinal grooves 12 are formed in both sides of the diagonal pillar 11 so as to oppose the pillars 3. The wall panels **4*a* have a triangular shape so as to be fitted between the vertical pillars 3 and the diagonal pillar 11. They are coupled to them by inserting both side edges thereof into the grooves 7 in the pillars 3 and the grooves 2 in the diagonal pillars 11. The diagonal pillar 11** serves to reinforce the whole framework.

Figure 5:
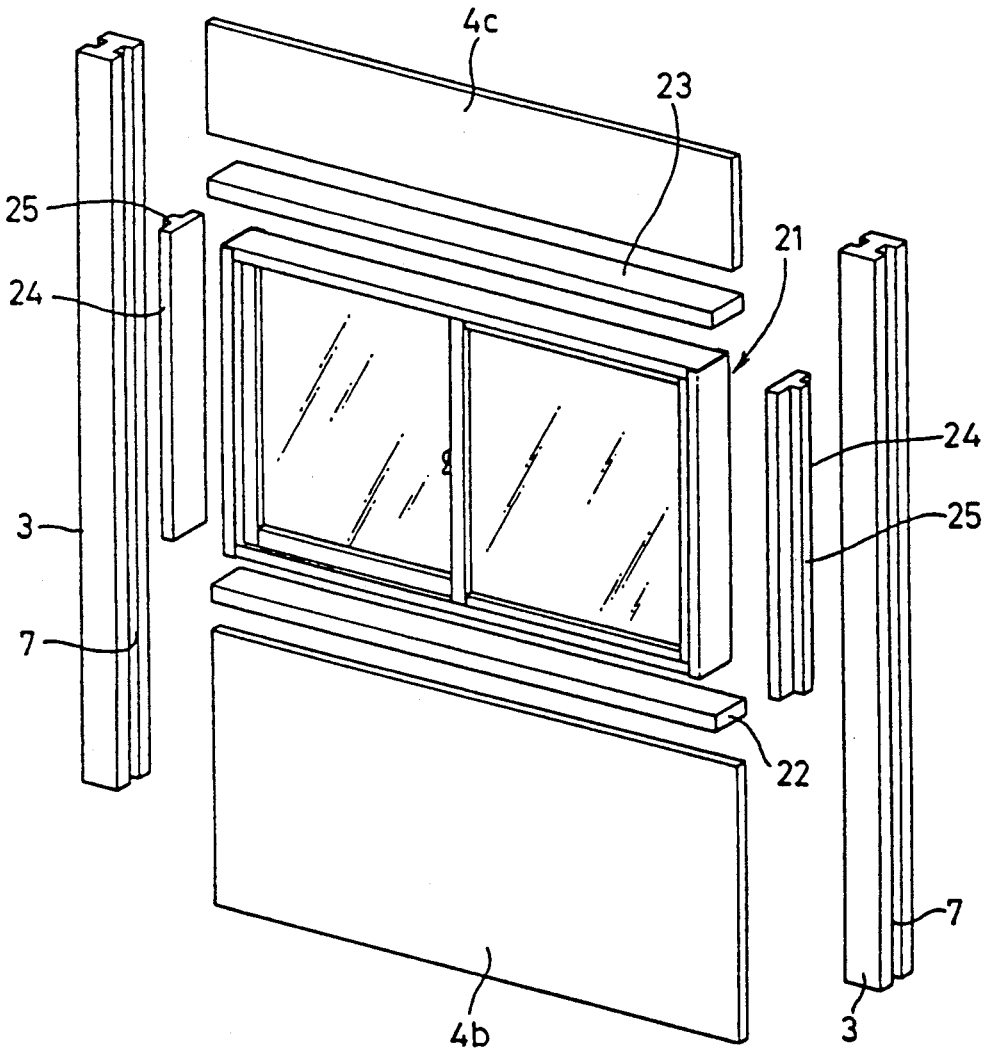
FIG. 5 is an exploded perspective view of a third embodiment.

FIG. 5 shows a third embodiment in which a fitting 21 is mounted in the framework. Its construction is basically the same as the first embodiment shown in FIG. 1. Thus, like parts are designated by like numerals and their description is omitted.

The fitting 21 is a window sash in this embodiment. Two wall panels **4*b* and 4*c* are provided over and under the fitting 21**.

The fitting 21 rests on a sill 22 placed on the lower wall panel **4*b*. The upper wall panel 4*c* rests on a window lintel 23 placed on the fitting 21**.

Mounting pillars 24 coupled to both sides of the fitting 21 and disposed between the fitting 21 and the vertical pillars 3 are formed each with a rib 25 adapted to be inserted in the grooves 7 in the pillars 3.

The fitting 21 may not be a window sash as shown but may be a swinging door or a sliding door (including traditional Japanese paper screens). Because the wall panels 4*b* and 4*c* can be adjusted to a fitting having any width and height simply by cutting them, the framework can be assembled easily at a construction site or in a factory as a unit.

These parts may be connected together by use of nails, clamps, bolts or other connector metals.

In the above-described embodiments, the framework has its wall panels supported between the vertical pillars 3 formed in their opposite ends with grooves 7 and arranged in series relation. It is, however, necessary to arrange the wall panels in many different ways, depending upon how the room is partitioned. The grooves 7 have to be formed in the corresponding position of the pillars 3.

FIGS. 6 to 9 show grooves 7 formed in different portions of the pillars 3.

Figure 6:
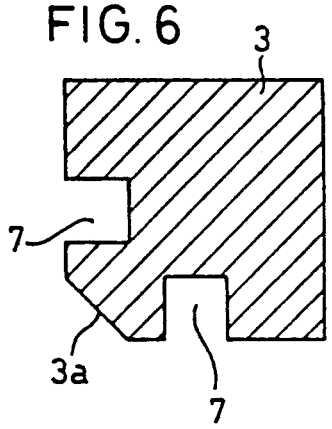
FIGS. 6 to 10 are sectional views of pillars having different sectional shapes from one another.
Figure 7:
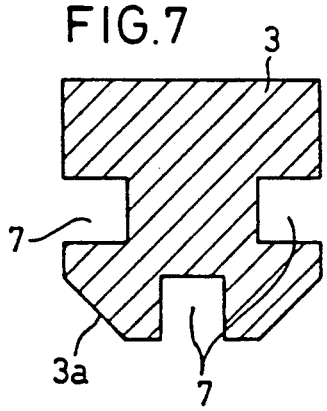
Figure 8:
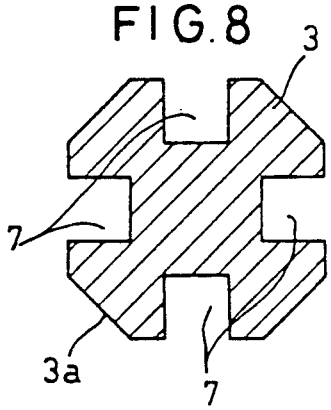
Figure 9:
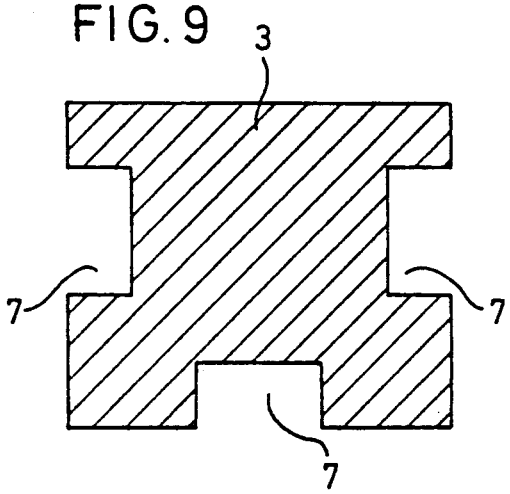
Figure 10:
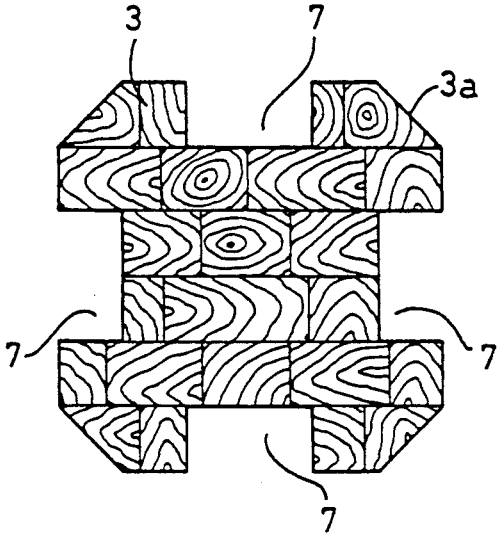

Namely, FIG. 6 shows a pillar for supporting two wall panels extending perpendicular to each other. FIG. 7 shows a pillar for supporting three wall panels extending in different directions. FIG. 8 shows a pillar for supporting four wall panels extending in different directions and FIG. 9 a pillar for supporting three rather thick wall panels 4*a*, 4*b* and 4*c* extending in different directions. The pillars 3 should have their corners chamfered as at points 5*a* for safety and beautiful finish. The pillars 3 may be solid. But from an economical viewpoint, they should be made of laminated lumber, as illustrated in FIG. 10.

The framework according to this invention is built between the floor and the ceiling, forming a wall surface. In the first embodiment, the pillars 3 are erected between the sill 1 and the pole plate 2 and the wall panel 4 is secured to the pillars 3 so as to extend vertically (see FIG. 1).

In the second embodiment, the diagonal pillar 11 is provided to extend diagonally between the pillars 3. The wall panels 4*a* and 4*b* are mounted between the pillars 3 and the diagonal pillar 11 to extend vertically.

What is claimed is:

1. A framework of a building, comprising:

a first straight pillar having a plurality of sides, at least one said side having a longitudinal groove therein;

a second straight pillar having a plurality of sides, at last one said side of said second straight pillar having a longitudinal groove therein, said sides of said first and second straight pillars being disposed opposite to and spaced from each other such that said longitudinal grooves are disposed opposite to and spaced from each other;

a third straight pillar, said third straight pillar extending diagonally from a lower portion of said first straight pillar to an upper portion of said second straight pillar between said first and second straight pillars, and said third straight pillar having first and second oppositely disposed sides thereof facing said first and second straight pillars, respectively, each said side having a longitudinal groove therein; and a plurality of wall panels, each said wall panel being mounted between a said first or second straight pillar and said third straight pillar extending diagonally, and each said wall panel having side edges inserted in a said longitudinal groove of said first or said second straight pillar and a said longitudinal groove of said third straight pillar.

2. The framework of claim 1, and further comprising a pole plate supporting said pillars and a sill disposed on top of said pillars.

3. The framework of claim 2, wherein said first and second straight pillars both have tenons extending at opposite ends thereof disposed in mortises in said pole plate and said sill.

4. The framework of claim 1, wherein each of said first and said second straight pillars has a plurality of said longitudinal grooves in respective said sides thereof.

5. The framework of claim 1, wherein said first, second and third straight pillars have H-shaped cross-sections.

6. A framework of a building, comprising:

a first straight pillar having a plurality of sides, at least one said side having a longitudinal groove therein;

a second straight pillar having a plurality of sides, at least one said side of said second straight pillar having a longitudinal groove therein, said sides of said first and second straight pillars being disposed opposite to and spaced from each other such that said longitudinal grooves are disposed opposite to and spaced from each other;

a plurality of wall panels disposed between said first and second straight pillars, said wall panels having side edges thereof inserted in said grooves of said first and second straight pillars;

a wall fitting mounted between said first and second straight pillars; and two separate mounting pillars disposed on respective opposite sides of said wall fitting between said wall fitting and said first and second straight pillars for mounting said wall fitting to said first and second straight pillars, said mounting pillars comprising longitudinally extending ribs inserted in said longitudinal grooves of said first and second straight pillars.

7. The framework of claim 6, wherein said wall fitting is a window casement.

8. The framework of claim 6, wherein said mounting pillars each have a rib length corresponding substantially to the extent of said wall fitting with respect to said longitudinal grooves of said first and second straight pillars.

9. The framework of claim 6, wherein each of said first and second straight pillars is an integral wooden member.

10. The framework of claim 6, wherein each of said first and said second straight pillars has a plurality of said longitudinal grooves in respective said sides thereof.

11. The framework of claim 6, and further comprising a sill disposed below said wall fitting and a lintel above said wall fitting.

12. The framework of claim 11, wherein both said sill and said lintel extend between said first and second straight pillars and extend between said wall fitting and respective said wall panels.

13. The framework of claim 7, and further comprising a sill disposed below said window casement and a lintel above said wall fitting.

14. The framework of claim 13, wherein both said sill and said lintel extend between said first and second straight pillars and extend between said wall fitting and respective said wall panels.

* * * * *